United States Patent [19]

Hammelmann

[11] 4,174,194

[45] Nov. 13, 1979

[54] RECIPROCATING PUMP

[76] Inventor: Paul Hammelmann, Zum Sundern 17, Oelde 1, Fed. Rep. of Germany, D-4740

[21] Appl. No.: 812,368

[22] Filed: Jul. 1, 1977

[30] Foreign Application Priority Data

Jul. 12, 1976 [DE] Fed. Rep. of Germany ..... 2631217

[51] Int. Cl.[2] ..... F04B 21/02

[52] U.S. Cl. ..... 417/567; 417/571

[58] Field of Search ..... 417/564, 567, 569, 571

[56] References Cited

U.S. PATENT DOCUMENTS

| | | | |
|---|---|---|---|
| 2,831,625 | 4/1958 | Hartwell et al. | 417/564 X |
| 3,050,237 | 8/1962 | Nicholas | 417/564 |
| 3,309,014 | 3/1967 | Bauer et al. | 417/567 |
| 3,811,801 | 5/1974 | Buse et al. | 417/454 |

FOREIGN PATENT DOCUMENTS

| | | | |
|---|---|---|---|
| 907014 | 3/1954 | Fed. Rep. of Germany | 417/469 |
| 2332250 | 3/1975 | Fed. Rep. of Germany | 417/457 |
| 513350 | of 1921 | France | 417/569 |
| 256506 | 12/1927 | Italy | 417/569 |
| 296979 | 5/1932 | Italy | 417/569 |
| 501626 | 11/1954 | Italy | 417/569 |
| 347490 | 4/1931 | United Kingdom | 417/569 |
| 1462145 | 1/1977 | United Kingdom | 417/469 |

*Primary Examiner*—Carlton R. Croyle
*Assistant Examiner*—Edward Look
*Attorney, Agent, or Firm*—Peter K. Kontler

[57] ABSTRACT

A reciprocating pump wherein the plunger is surrounded by a sleeve which has limited freedom of axial movement in the pump body and has a conical end portion adjacent to the lightweight washer-like or hollow frustoconical valving element of a suction valve. When the plunger performs a suction stroke, pressure in the sleeve drops below the pressure at the inlet of the pump body whereby the suction valve opens and allows fluid to flow into the sleeve. The plunger thereupon performs a forward stroke to pressurize the fluid in the sleeve, whereby the suction valve closes, and to expel pressurized fluid through the central opening of the valving element and through a delivery valve which admits pressurized fluid into a plenum chamber.

12 Claims, 3 Drawing Figures

RECIPROCATING PUMP

BACKGROUND OF THE INVENTION

The present invention relates to reciprocating pumps in general, and more particularly to improvements in reciprocating pumps of the type wherein a plunger is surrounded by a sleeve-like tubular member which receives fluid from the inlet of the pump housing during each return stroke of the plunger and from which pressurized fluid is expelled when the plunger performs a forward stroke. As a rule, such pumps are used for effecting pronounced pressurization of a liquid on its way from the inlet or inlets to the outlet or outlets of the pump housing.

In presently known pumps of the just outlined character, the tubular member performs the function of a suction valve. To this end, the tubular member is reciprocable in the pump housing so as to permit fluid to flow from the inlet (and more particularly from a chamber which is defined by the tubular member and the pump housing) into its interior while the plunger moves away from the delivery valve and to seal its interior from the inlet while the plunger performs a forward stroke. A drawback of such pumps is that the mass of the tubular member is large so that the tubular member cannot reciprocate with a sufficient degree of reproducibility when the plunger is driven at a high speed.

OBJECTS AND SUMMARY OF THE INVENTION

An object of the invention is to provide a reciprocating pump wherein the plunger can be reciprocated at a frequency greatly exceeding the frequency of plungers in heretofore known pumps.

Another object of the invention is to provide a novel and improved arrangement of valves in a reciprocating pump of the type wherein the plunger is movable within a floating tubular member.

A further object of the invention is to provide novel and improved suction valves for use in reciprocating pumps.

An additional object of the invention is to provide a reciprocating pump, especially a pump which is designed to effect pronounced pressurization of conveyed fluid, wherein the mass of moving parts is a relatively small fraction of the mass of moving parts in heretofore known plunger type reciprocating pumps.

Still another object of the invention is to provide a reciprocating pump which comprises a relatively small number of simple and rugged parts, which can be readily assembled or taken apart to afford access to its valves, plunger and/or other components, and which can deliver pressurized fluid at a predictable rate within a wide range of speeds.

The invention is embodied in a reciprocating pump which comprises a pump housing or body having at least one fluid-admitting inlet, a tubular member which is mounted in the housing and comprises a hollow conical end portion, a plunger which is reciprocable in the tubular member, a lightweight suction valve having a mobile valving element (e.g., a washer-like annulus or a hollow frustum of a cone) installed in the housing intermediate the inlet and the conical end portion of the tubular member to normally seal the inlet from the interior of the tubular member, an opening provided in the valving element of the suction valve for the flow of fluid from the tubular member, a delivery valve installed in the housing downstream of the suction valve (as considered in the direction of fluid flow from the interior of the tubular member toward the outlet of the pump housing) and arranged to open in response to the flow of fluid from the interior of the tubular member via opening of the valving element, and means for alternately moving the plunger in a first direction away from the conical end portion of the tubular member (this results in a reduction of pressure in the interior of the tubular member with attendant opening of the suction valve to permit the fluid to flow from the inlet of the housing into the tubular member) and in a second direction toward the conical end portion of the tubular member to thereby pressurize the fluid in the tubular member and to expel the pressurized fluid by way of the opening in the valving element and through the delivery valve.

It is preferred to install the tubular member in such a way that the housing and its external surface define a fluid-filled chamber which communicates with the inlet of the housing and communicates with the interior of the tubular member while the plunger moves in the first direction. It is further preferred to provide the housing with an internal stop for the conical end portion of the tubular member; the conical end portion abuts against the stop while the plunger moves in the second direction. In contrast to heretofore known pumps, the extent of axial movement of the tubular member in the housing is negligible, e.g., a small fraction of one millimeter. Therefore, the mass of moving parts in the housing is very small because, in addition to the reciprocable plunger, the only additional moving means are the valving elements of the suction and delivery valves.

The novel features which are considered as characteristic of the invention are set forth in particular in the appended claims. The improved pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
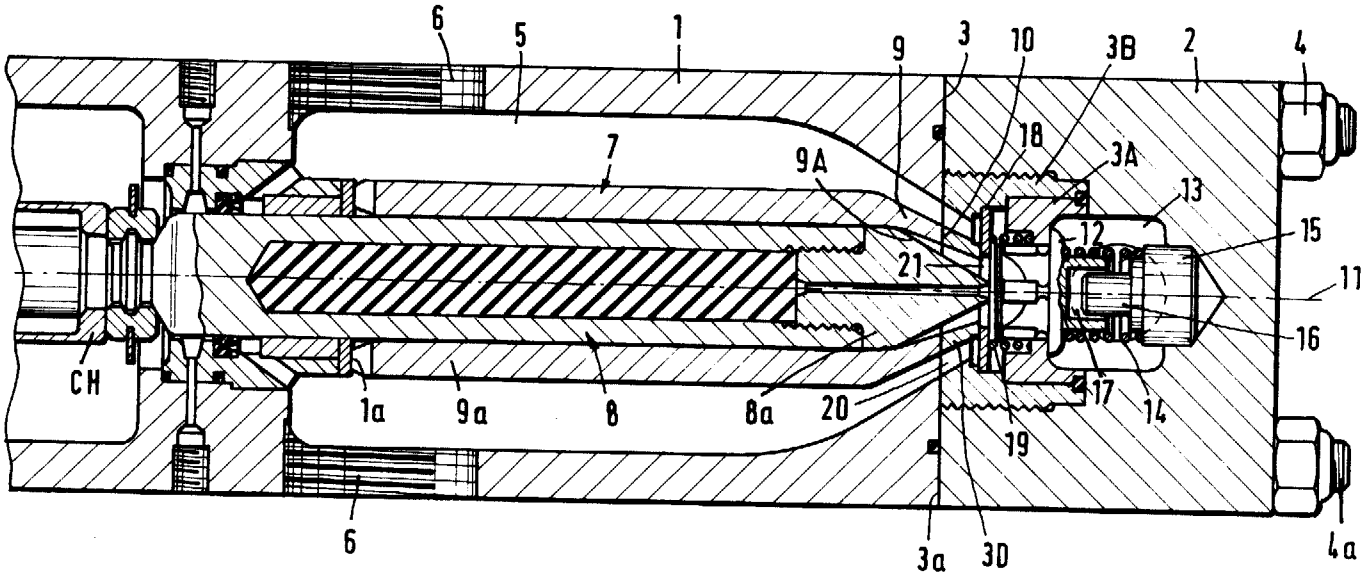
FIG. 1 is a fragmentary axial sectional view of a reciprocating pump which embodies one form of the invention.
Figure 3:
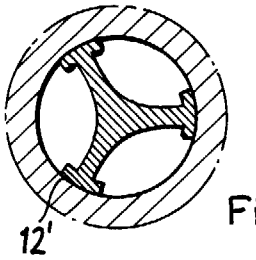
FIG. 3 is a sectional view as seen in the direction of arrows from the line III—III of FIG. 2.

Referring first to FIG. 1, there is shown a reciprocating pump which comprises a body or housing including a first or main section 1 and a second section or head 2. The section 2 has bores (not specifically shown) for bolts 4a which are anchored in the main section 1 and mesh with nuts 4 to hold the end face 3a of the section 2 in permanent abutment with the adjacent end face 3 of the section 1. The section 1 has one or more inlets 6 which are connected with a source (not shown) of fluid (e.g., liquid) to be pumped and are in permanent communication with an annular suction chamber 5 defined by the internal surface of the main section 1 and the external surface of a sleeve-like tubular member 7 which is reciprocable, within narrow limits, relative to the housing 1, 2 with or with respect to a reciprocable plunger 8. The housing has two stops for the respective end portions 9 and 9a of the tubular member 7 (hereinafter called sleeve for short). One of these stops is the end face 3a of the section 2, and the other stop 1a is provided in the section 1 between the two illustrated inlets 6. The extent of axial movement of the sleeve 7 in the housing is preferably a small fraction of one millimeter, for example, 0.1 millimeter. That end portion (9) of the sleeve 7 which is adjacent to the end face or stop 3a constitutes a hollow cone whose end is open to allow for admission of fluid into and for expulsion of pressurized fluid from the interior of the sleeve 7. The external surface of the conical end portion 9 tapers in a direction toward the section 2 of the pump housing to make an acute angle with the axis of the plunger 8.

A portion of the cavity in the end face 3a of the section 2 constitutes a fluid collecting compartment or plenum chamber 13 which receives highly pressurized fluid from the interior of the sleeve 7 when the plunger 8 performs a forward stroke toward the end position which is shown in FIG. 1. Pressurized fluid opens a delivery valve having a reciprocable valving element 12 which is biased against a seat 3A by a helical spring 14 reacting against the section 2. The valving element 12 has a socket 17 for a guide element here shown as a stud 16 having an enlarged portion 15 received in a blind bore of the section 2. The delivery valve including the valving element 12, seat 3A and spring 14 is coaxial with the plunger 8 and sleeve 7. The seat 3A forms part of a composite insert which further includes a second seat 3B for the valving element 18 of a suction valve. The seat 3B has external threads in mesh with internal threads of the section 2, and the left-hand end face of the seat 3B is flush with (and can be said to form part of) the end face 3a. The valving element 18 of the suction valve is an annulus (in the embodiment of FIG. 1, the element 18 is a flat washer) which is yieldably biased against the seat 3B by a helical valve spring 19 reacting against the seat 3A, i.e., against the section 2. The valving element 18 has a central opening 21 which admits pressurized fluid against the valving element 12 of the delivery valve when the plunger 8 moves toward the end position of FIG. 1.

The seat 3B has an annular array of ports 20 which communicate with the chamber 5 an admit fluid into the sleeve 7 when the valving element 18 is lifted against the opposition of the spring 19, i.e., when the plunger 8 moves in a direction to the left to reduce the pressure in the interior of the sleeve 7 so that fluid which fills the chamber 5 opens the suction valve and flows into the sleeve via conical end portion 9.

The means for reciprocating the plunger 8 comprises a crosshead CH which is coupled to the rear end of the plunger and is reciprocated by an eccentric or crank, not shown. Such eccentric or crank can receive torque from a suitable motor, e.g., a variable-speed electric motor.

That portion (3D) of the seat 3B which is immediately adjacent to the end face 3a of the section 2 preferably constitutes a hollow frustoconical extension of the conical end portion 9. The portion 3D abuts against or is immediately adjacent to the end face 10 of the end portion 9 and is surrounded by the ports 20. The inclination of the axes of these ports preferably equals or closely approximates the inclination of the external (peripheral) surface of the end portion 9 with respect to the axis 11 of the plunger 8. The extent to which the sleeve 7 is movable axially in the housing of the pump is just sufficient to compensate for temperature-induced changes in length of the sleeve, i.e., the sleeve need not act as a suction valve. The mass of the suction valve (and more particularly of the valving element 18) is a minute fraction of the mass of the sleeve 7 so that the suction valve can open and close at a frequency which is a multiple of the frequency of opening and closing the suction valve of a conventional reciprocating pump wherein the sleeve forms part (valving element) of the suction valve. The sleeve 7 can be said to float on the plunger 8.

The operation is as follows:

When the crosshead CH moves the plunger 8 in a direction to the left, as viewed in FIG. 1, the pressure in the interior of the sleeve 7 drops below atmospheric pressure whereby the fluid which fills the chamber 5 opens the suction valve by moving the valving element 18 away from the seat 3B against the opposition of the spring 19. The valving element 18 then allows fluid to flow into and through the ports 20, to overflow the conical portion 3D of the seat 3B and to enter the interior of the sleeve 7 via hollow conical end portion 9. The delivery valve is closed because the relatively strong spring 14 urges the valving element 12 against the seat 3A.

When the plunger 8 begins to move in the opposite direction (i.e., back toward the end position of FIG. 1), it pressurizes the fluid in the sleeve 7 whereby the pressure of such fluid rises above atmospheric pressure and the spring 19 is free to immediately return the valving element 18 to the illustrated position in which the ports 20 are sealed from the interior of the sleeve 7. The pressurized fluid acts against the conical internal surface 9A of the end portion 9 and maintains the end face 10 in sealing engagement with the end face 3a, i.e., with the portion 3D of the seat 3B. The fluid flows through the opening 21 of the valving element 18 and opens the delivery valve by moving the valving element 12 away from the seat 3A, i.e., pressurized fluid can enter the plenum chamber 13 which communicates with the outlet (not shown) of the housing.

The combined cross-sectional area of the ports 20 exceeds the cross-sectional area of the along which fluid flows from these ports into the sleeve 7 when the suction valve is open. When the valving element 18 seals the ports 20 from the interior of the sleeve 7, it abuts against the portion 3D of the seat 3B.

The front end portion 8a of the plunger 8 is conical and its tip is located in or immediately adjacent to the central opening 21 of the valving element 18 when the plunger reaches the right-hand end position of FIG. 1, i.e., when the plunger completes its forward stroke.

Other pump components which are shown in FIG. 1 but not specifically mentioned or referenced are of conventional design or form no part of the present invention.

Figure 2:
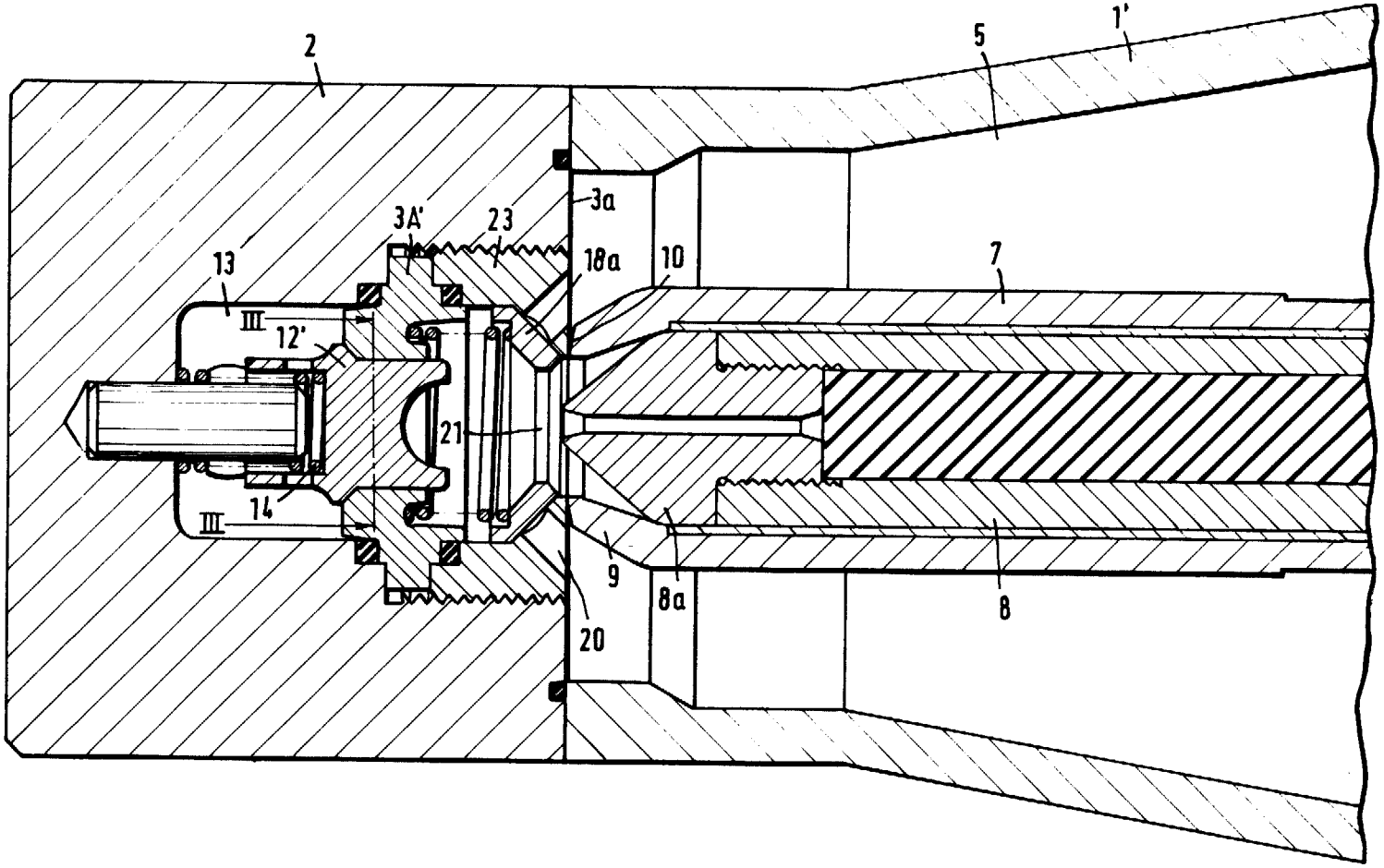
FIG. 2 is a fragmentary axial sectional view of a modified reciprocating pump.

The reciprocating pump of FIG. 2 differs from the just described pump in that the housing section 1' is not a cylinder, that the delivery valve includes a modified valving element 12', and that the valving element 18a of the suction valve is a hollow frustum of a cone which tapers in a direction toward the hollow conical end portion 9 of the sleeve 7. The conicity of the valving element 18a promotes the flow of fluid from the suction chamber 5 into the interior of the sleeve 7 when the plunger 8 is caused to move in a direction to the right, as viewed in FIG. 2. The seat for the valving element 18a of the suction valve is denoted by the reference character 23; this seat meshes with the section 2 of the pump housing and confines a second seat 3A' corresponding to the seat 3A of FIG. 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. A reciprocating pump, comprising a housing having at least one fluid-admitting inlet; a tubular member mounted in said housing and including a hollow conical end portion; a plunger reciprocable in said tubular member; a lightweight suction valve having a mobile valving element installed in said housing intermediate said inlet and said conical end portion to normally seal said inlet from the interior of said tubular member, said valving element having an opening for the flow of fluid from said tubular member and being movable to an open position in which said valve defines a path for the flow of fluid from said inlet into said tubular member, said housing including a hollow conical portion constituting an extension of said conical end portion and being disposed between said tubular member and said valving element; a delivery valve installed in said housing downstream of said suction valve and arranged to open in response to flow of fluid from said tubular member via said opening; and means for alternately moving said plunger in a first direction away from said conical end portion to thereby reduce the pressure in the interior of said tubular member with attendant movement of said valving element to open position and the resulting flow of fluid from said inlet into said tubular member by way of said path, and in a second direction toward said conical end portion to thereby pressurize the fluid in said tubular member and to expel the pressurized fluid via said opening and said delivery valve.

2. A pump as defined in claim 1, wherein said housing and said tubular member define a fluid-filled chamber which communicates with said inlet and which communicates with the interior of said tubular member by way of said path in the open position of said valving element.

3. A pump as defined in claim 2, wherein said housing includes an internal stop against which said conical end portion of said tubular member abuts during movement of said plunger in said second direction, said delivery valve being coaxial with said plunger.

4. A pump as defined in claim 2, wherein said housing has ports which communicate with said chamber and are normally sealed from the interior of said tubular member by the valving element of said suction valve, the combined cross-sectional area of said ports exceeding the cross-sectional area of said path.

5. A pump as defined in claim 4, wherein said conical end portion of said tubular member has a peripheral surface tapering toward said valving element at a predetermined angle to the axis of said plunger, said ports being outwardly adjacent to said peripheral surface and having axes which are inclined with respect to the axis of said plunger.

6. A pump as defined in claim 5, wherein the axis of each of said ports makes with the axis of said plunger an angle which equals or closely approximates said predetermined angle.

7. A pump as defined in claim 1, wherein said suction valve further comprises a seat provided in said housing and means for yieldably biasing said valving element against said seat, said valving element constituting an annulus.

8. A pump as defined in claim 7, wherein said biasing means includes a spring which reacts against said housing and bears against said annulus.

9. A pump as defined in claim 1, wherein said tubular member further includes a second end portion and said housing includes stops for said end portions, said tubular member having limited freedom of axial movement between said stops.

10. A pump as defined in claim 9, wherein the distance between said stops exceeds the length of said tubular member by a small fraction of one millimeter.

11. A pump as defined in claim 1, wherein said plunger comprises a conical end portion which is located in close proximity to said suction valve whenever said plunger completes a movement in said second direction.

12. A pump as defined in claim 1, wherein said valving element is a hollow frustum of a cone.

* * * * *